US007178738B2

(12) United States Patent
Yamamoto et al.

(10) Patent No.: US 7,178,738 B2
(45) Date of Patent: Feb. 20, 2007

(54) CONTROL SYSTEM FOR AIR CONDITIONER AND AIR CONDITIONER

(75) Inventors: Mitsuhiko Yamamoto, Sakai (JP); Nobuhiro Imada, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/492,934

(22) PCT Filed: Oct. 24, 2002

(86) PCT No.: PCT/JP02/11074

§ 371 (c)(1),
(2), (4) Date: Apr. 19, 2004

(87) PCT Pub. No.: WO03/036183

PCT Pub. Date: May 1, 2003

(65) Prior Publication Data

US 2004/0261432 A1 Dec. 30, 2004

(51) Int. Cl.
*G05D 23/00* (2006.01)
*F24F 7/00* (2006.01)
*F25B 49/00* (2006.01)

(52) U.S. Cl. ..... 236/51; 236/49.3; 62/132

(58) Field of Classification Search ..... 62/175, 62/126, 127, 129, 130, 132; 236/51, 94; 165/11.1, 11.2, 208, 209
See application file for complete search history.

(56) References Cited

U.S. PATENT DOCUMENTS

| | | | | |
|---|---|---|---|---|
| 5,224,648 | A * | 7/1993 | Simon et al. | 236/51 |
| 5,711,480 | A * | 1/1998 | Zepke et al. | 236/51 |
| 6,378,315 | B1 * | 4/2002 | Gelber et al. | 62/80 |
| 6,453,687 | B2 * | 9/2002 | Sharood et al. | 62/127 |
| 6,647,735 | B2 * | 11/2003 | Street et al. | 62/132 |
| 6,874,691 | B1 * | 4/2005 | Hildebrand et al. | 236/51 |
| 6,912,429 | B1 * | 6/2005 | Bilger | 236/49.3 |

FOREIGN PATENT DOCUMENTS

| | | |
|---|---|---|
| JP | 11-211200 | 8/1999 |
| JP | 2000-161753 | 6/2000 |
| JP | 2000-304335 | 11/2000 |

* cited by examiner

*Primary Examiner*—Chen Wen Jiang
(74) *Attorney, Agent, or Firm*—Global IP Counselors

(57) ABSTRACT

A control system for an air conditioner is configured that can wirelessly transmit control signals, and allow the output power settings of transceiver units arranged in the outdoor unit and indoor units to be reduced. The air conditioner control system includes an outdoor unit transceiver unit, indoor unit transceiver units, and a center. The outdoor unit transceiver unit is arranged in an outdoor unit, and transmits and receives control signals. The indoor unit transceiver units are respectively arranged in the indoor units, and transmit and receive control signals. The center wirelessly relays control signals between the outdoor unit transceiver unit and the indoor unit transceiver units.

20 Claims, 1 Drawing Sheet

CONTROL SYSTEM FOR AIR CONDITIONER AND AIR CONDITIONER

TECHNICAL FIELD

The present invention relates to a control system for an air conditioner and an air conditioner.

BACKGROUND ART

With separate type air conditioners, an outdoor unit placed outdoors and an indoor unit installed indoors are connected via a transmission line. Various types of control signals such as operation ON/OFF signals, temperature settings, operation modes, and the like are transmitted by means of this transmission line.

In the past, transmission lines would become tangled in situations in which a large number of indoor units and outdoor units were connected together. In addition, the transmission lines would become tangled in situations in which there is a large distance between the indoor units and the outdoor unit, even if one indoor unit is connected to one outdoor unit.

It is thought that these types of problems will be solved by installing a transceiver unit that transmits and receives control signals in both the outdoor unit and the indoor unit, and transmitting the control signals wirelessly instead of using a wired transmission line.

However, in order to wirelessly transmit and receive control signals between the outdoor unit and the indoor unit, the transceiver units must either have good reception sensitivity or a high transmission output power. When transceiver units having these types of transmission and reception capabilities are used, one problem created thereby is an increase in costs.

DISCLOSURE OF THE INVENTION

An object of the present invention is to provide a control system for an air conditioner and an air conditioner that can wirelessly transmit control signals, and allow the output power settings of transceiver units arranged in an outdoor unit and indoor units to be reduced.

In a first aspect of the present invention, the invention is a control system for an air conditioner including an outdoor unit and an indoor unit, and comprises an outdoor unit transceiver unit, an indoor unit transceiver unit, and a center. The outdoor unit transceiver unit is arranged in the outdoor unit, and transmits and receives control signals. The indoor unit transceiver unit is arranged in the indoor unit, and transmits and receives control signals. The center wirelessly relays control signals between the outdoor unit transceiver unit and the indoor unit transceiver unit.

Here, the control signals that are transmitted from the outdoor unit transceiver unit are relayed by the center, and are then transmitted to the indoor unit transceiver unit. Thus, by improving the center's reception sensitivity, the center can receive the control signals transmitted from the outdoor unit transceiver unit, even if the output power of the transmission from the outdoor unit transceiver unit is weak. In addition, even if the reception sensitivity of the indoor unit transceiver units is low, the indoor unit transceiver unit can receive the control signals relayed by the center by increasing the output power of the center's transmissions. The same is true with respect to the control signals transmitted from the indoor unit transceiver unit. Thus, according to the present invention, control signals can be wirelessly transmitted, and the output power settings of the transceiver unit arranged in the outdoor unit and the indoor unit can be reduced.

In a second aspect of the present invention, the invention an air conditioner that includes an outdoor unit and an indoor unit, utilizes an external communication network, and comprises an outdoor unit transceiver unit and an indoor unit transceiver unit. The outdoor unit transceiver unit is arranged in the outdoor unit, and wirelessly transmits control signals to and receives control signals from the communication network. The indoor unit transceiver unit is arranged in the indoor unit, and wirelessly transmits control signals to and receives control signals from the communication network.

Here, control signals are transmitted from the outdoor unit transceiver unit and received by the indoor unit transceiver unit, and transmitted from the indoor unit transceiver unit and received by the outdoor transceiver unit, via the external communication network. Because of this, control signals can be transmitted at an output power that is lower than that of control signals that are directly wirelessly transmitted between the indoor unit transceiver unit and the outdoor unit transceiver unit. Thus, according to the present invention, an external communication network can be utilized to wirelessly transmit control signals, and the output power settings of the transceiver units arranged in the outdoor unit and the indoor unit can be reduced.

In a third aspect of the present invention, the invention is an air conditioner that utilizes an external communication network, and which comprises an outdoor unit transceiver unit arranged in an outdoor unit that wirelessly transmits and receives control signals, and an indoor unit transceiver unit arranged in an indoor unit that wirelessly transmits and receives control signals. The air conditioner wirelessly transmits control signals between the outdoor unit transceiver unit and the indoor unit transceiver unit via the communication network.

Here, the wireless transmission of control signals between the outdoor unit transceiver unit and the indoor unit transceiver unit is performed via the external communication network. Because of this, control signals can be transmitted at an output power that is lower than that of control signals that are directly and wirelessly transmitted between the indoor unit transceiver unit and the outdoor unit transceiver unit. Thus, according to the present invention, an external communication network can be utilized to wirelessly transmit control signals, and the output power settings of the transceiver units arranged in the outdoor unit and the indoor unit can be reduced.

Figure 1:
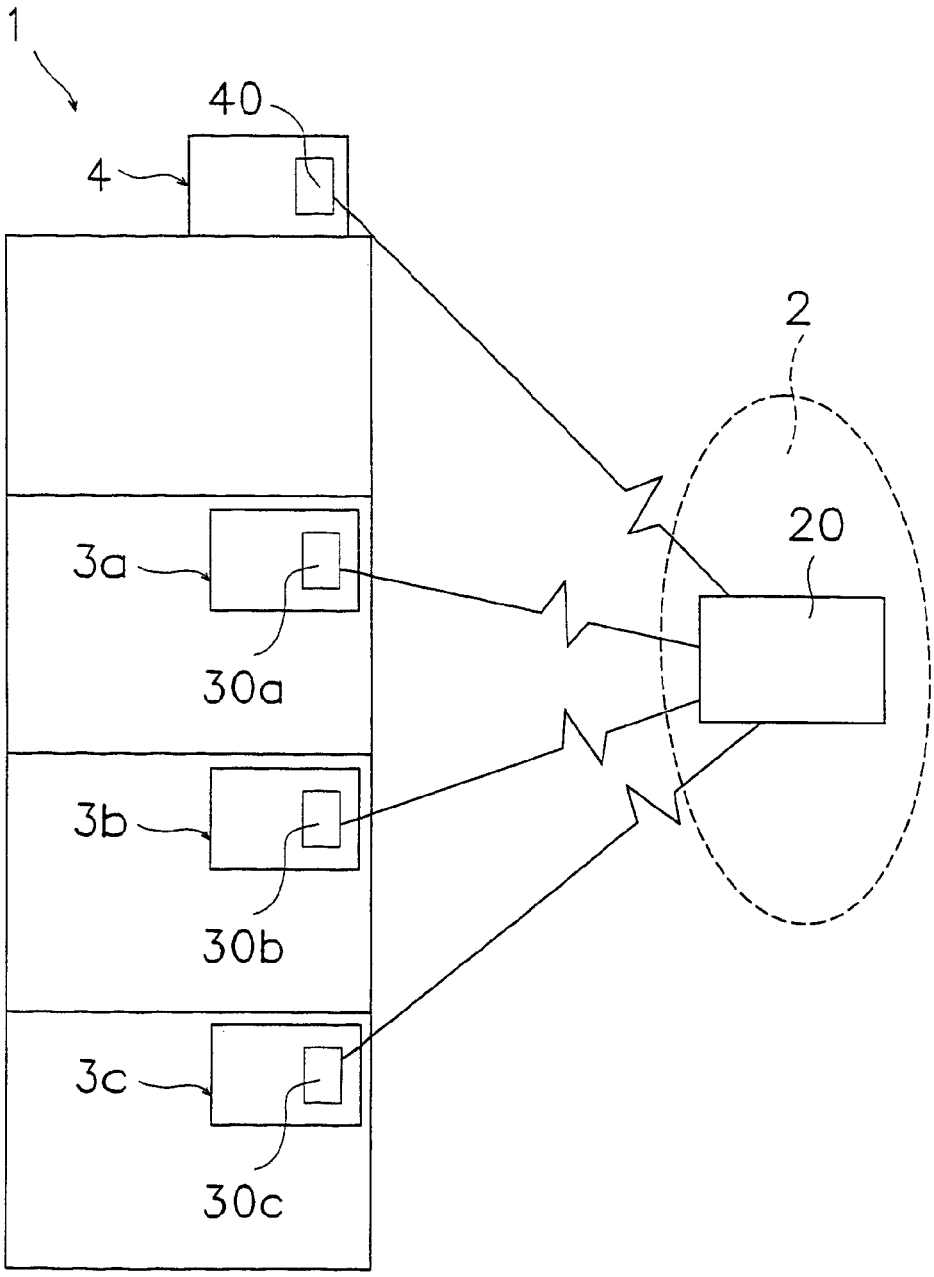
FIG. 1 is a schematic view of a control system for an air conditioner according to one embodiment of the present invention.

BEST MODE FOR CARRYING OUT THE INVENTION (System configuration)

FIG. 1 shows a control system according to one embodiment of the present invention. Here, it is assumed that an air conditioner is installed in a building 1. Indoor units 3*a*, 3*b*, 3*c* of the air conditioner are installed on each floor of the building 1. An outdoor unit 4 is installed on the roof of the building 1. The control system according to the present embodiment includes an outdoor unit transceiver unit 40, indoor unit transceiver units 30*a*, 30*b*, 30*c*, and a center 20.

The outdoor unit transceiver unit 40 wirelessly transmits and receives control signals, and is arranged in the outdoor unit 4.

The indoor unit transceivers 30*a*, 30*b*, 30*c* transmit and receive control signals, and are respectively arranged in the indoor units 3*a*, 3*b*, 3*c*.

The center 20 forms a portion of an external communication network 2, or is connected to the communications network 2. The center 20 is outside the building 1, and wirelessly relays control signals between the indoor unit transceiver units 30*a*, 30*b*, 30*c* and the outdoor unit transceiver 40. Note that the center 20 may serve to simply relay the control signals, or may also function to store the control signals exchanged between the outdoor unit 4 and the indoor units 3*a*, 3*b*, 3*c* and use them to monitor the air conditioner. Here, the wireless communication network 2 may be a PHS, cellular telephone, or other similar type of communication network.

(System Operation)

A situation in which a user places an operation switch for a controller of the indoor unit 3*a* into the ON position in order to initiate the operation of the air conditioner will be used as an example. First, the operation ON signal is transmitted from the controller of the indoor unit 3*a* to the indoor unit transceiver unit 30*a*, and is then wirelessly transmitted from the indoor unit transceiver unit 30*a*. The operation ON signal is received by the center 20, and is transmitted to the outdoor unit transceiver unit 4 with a power output that is larger than that of the indoor unit transceiver unit 30*a*. The transmitted operation ON signal is received by the outdoor unit transceiver unit 40, and is read into the controller of the outdoor unit 4. Then, the controller starts the outdoor unit 4, and the operation of the air conditioner will initiate. Note that control signals other than the operation ON signal, e.g., control signals for changes in the temperature setting, operation mode, or the like, can also be wirelessly transmitted from the indoor unit transceiver unit 30*a* to the outdoor unit transceiver unit 40 by relaying them via the center 20 in the same way. Conversely, control signals that are transmitted from the outdoor unit transceiver unit 40 can also be wirelessly transmitted to the indoor unit transceiver unit 30*a* by relaying them via the center 20 in the same way.

(Special Characteristics of the System)

Even if the transmission and the receiving capabilities of the outdoor unit transceiver unit 40 and the indoor unit transceiver units 30*a*, 30*b*, 30*c* are poor, the present system can transmit control signals by improving the transmission and receiving capabilities of the center 20 that will relay the signals. Because of this, control signals can be wirelessly transmitted by means of transceiver units having capabilities that are lower than the capabilities needed to directly transmit control signals between each transceiver unit. This allows control signals to be wirelessly transmitted, and allows the output power settings of the transceiver units arranged in the outdoor unit and indoor units to be reduced. In addition, increases in costs can also be held in check.

[Other Embodiments]

The aforementioned embodiment is a control system adapted for use in an air conditioner composed of one outdoor unit 4 and three indoor units 3*a*, 3*b*, 3*c*, but the number of outdoor units and indoor units is not limited thereto. In other words, the present control system can be adapted for an air conditioner that is composed of two or more outdoor units and more than or less than three indoor units.

In addition, the location to which wireless signals are transmitted and from which they are received need not be limited to the center 20. For example, there may be one or more base stations that are connected to the center 20 via the communication network 2, such as a PHS or a cellular phone. In other words, the center 20 does not only refer to one device in the communication network 2, but should also be understood to include one or more base stations of the communication network 2 and a communication network that connects the base stations and the center 20.

INDUSTRIAL APPLICABILITY

The present invention allows control signals to be wirelessly transmitted, and allows the output power settings of the transceiver units arranged in the outdoor unit and indoor units to be reduced.

What is claimed is:

1. A control system for an air conditioner comprising:

an outdoor unit transceiver unit configured to be arranged in an outdoor unit of the air conditioner and to transmit and receive control signals;

an indoor unit transceiver unit configured to be arranged in an indoor unit of the air conditioner and to transmit and receive control signals, each of the outdoor and indoor unit transceiver units having a first output power level for transmitting the control signals; and a center configured to wirelessly relay said transmitted control signals of the outdoor unit transceiver unit to the indoor unit transceiver unit and wirelessly relay the transmitted control signals of the indoor unit transceiver unit to the outdoor unit transceiver unit, the center having a second output power level larger than the first output power level for amplifying and transmitting the control signals received from the indoor unit transceiver unit or the outdoor unit transceiver unit without materially changing the control signals.

2. The control system for an air conditioner as recited in claim 1, wherein the outdoor unit transceiver unit is not capable of directly transmitting the control signals to the indoor unit transceiver unit and the indoor unit transceiver unit is not capable of directly transmitting the control signals to the outdoor unit transceiver unit.

3. The control system for an air conditioner as recited in claim 1, wherein the outdoor unit transceiver unit is dependent on the center for transmission of the control signals to the indoor unit transceiver unit.

4. The control system for an air conditioner as recited in claim 1, wherein the indoor unit transceiver unit is dependent on the center for transmission of the control signals to the outdoor unit transceiver unit.

5. The control system for an air conditioner as recited in claim 1, wherein the center is a communication network.

6. The control system for an air conditioner as recited in claim 1, wherein the center is a portion of a communication network.

7. The control system for an air conditioner as recited in claim 6, wherein the center includes a cellular telephone.

8. The control system for an air conditioner as recited in claim 1, wherein the center includes one or more base stations and a communication network that connects the one or more base stations and the center.

9. The control system for an air conditioner as recited in claim 8, wherein the one or more base stations includes a cellular telephone.

10. The control system for an air conditioner as recited in claim 1, wherein the center stores the control signals and uses the control signals to monitor the air conditioner.

11. A method of controlling an air conditioner comprising:

providing an outdoor transceiver unit configured to wirelessly transmit and receive control signals, an indoor transceiver unit configured to wirelessly transmit and receive control signals and a center configured to wirelessly relay control signals between the outdoor transceiver unit and the indoor transceiver unit, each of the outdoor and indoor transceiver units having a first output power level for transmitting the control signals, the center having a second output power level for transmitting the control signals that is larger than the first output power level; and relaying the control signals from the outdoor transceiver unit or the indoor transceiver unit to the other of the outdoor transceiver unit and the indoor transceiver unit via the center at the second output power level.

12. The method of controlling an air conditioner as recited in claim 11, wherein the outdoor transceiver unit is not capable of directly transmitting the control signals to the indoor transceiver unit and the indoor transceiver unit is not capable of directly transmitting the control signals to the outdoor transceiver unit.

13. The method of controlling an air conditioner as recited in claim 11, wherein the outdoor transceiver unit is dependent on the center for transmission of the control signals to the indoor transceiver unit.

14. The method of controlling an air conditioner as recited in claim 11, wherein the indoor transceiver unit is dependent on the center for transmission of the control signals to the outdoor transceiver unit.

15. The method of controlling an air conditioner as recited in claim 11, wherein the center is a communication network.

16. The method of controlling an air conditioner as recited in claim 11, wherein the center is a portion of a communication network.

17. The method of controlling an air conditioner as recited in claim 16, wherein the center includes a cellular telephone.

18. The method of controlling an air conditioner as recited in claim 11, wherein the center includes one or more base stations and a communication network that connects the one or more base stations and the center.

19. The method of controlling an air conditioner as recited in claim 18, wherein the one or more base stations includes a cellular telephone.

20. The method of controlling an air conditioner as recited in claim 11, wherein the center stores the control signals and uses the control signals to monitor the air conditioner.

* * * * *